United States Patent [19]

McSparran

[11] Patent Number: 4,730,177

[45] Date of Patent: Mar. 8, 1988

[54] SHOCK AND VIBRATION RESISTANT MAGNETICALLY OPERATED ACTUATOR

[75] Inventor: Joseph F. McSparran, Cherry Hill, N.J.

[73] Assignee: RCA Corporation, Princeton, N.J.

[21] Appl. No.: 874,455

[22] Filed: Jun. 16, 1986

[51] Int. Cl.[4] ..... H01F 7/08; H01F 7/14

[52] U.S. Cl. ..... 335/272; 335/100; 335/225

[58] Field of Search ..... 335/272, 122, 136, 229, 335/230, 68, 100, 225; 310/36-37

[56] References Cited

U.S. PATENT DOCUMENTS

| | | | |
|---|---|---|---|
| 2,820,866 | 1/1958 | Graybill et al. | 200/104 |
| 2,866,031 | 12/1958 | Findley, Jr. | 200/206 |
| 3,783,423 | 1/1974 | Mater et al. | 335/174 |
| 4,164,722 | 8/1979 | Garvey | 335/272 |
| 4,275,371 | 6/1981 | Vogel | 335/272 |
| 4,423,296 | 12/1983 | McSparran | 200/67 A |

*Primary Examiner*—E. A. Goldberg

*Assistant Examiner*—L. Donovan

*Attorney, Agent, or Firm*—Clement A. Berard, Jr.; William H. Meise; William Squire

[57] ABSTRACT

A set of magnetically responsive vanes are secured for rotation about their mass center of gravity in a given angular spacing. The vanes have corresponding magnetic field producing coils which are in a different angular spacing such that one coil and vane is aligned and a second coil and vane are misaligned. An electrical switch is coupled to the vanes for operation in response to rotation of the vanes. A current applied to one coil aligns its vane thereto and closes the switch. The closed switch applies a load current to a second coil whose vane is misaligned. When an overcurrent occurs, the corresponding resulting field aligns its vane and opens the switch. An off current applied to a coil can align a corresponding vane to also open the switch. The switch and actuator are dynamically balanced so that moments produced by shock and vibration do not operate the actuator vanes or switch.

13 Claims, 3 Drawing Figures

SHOCK AND VIBRATION RESISTANT MAGNETICALLY OPERATED ACTUATOR

The present invention relates to magnetically operated actuators and, more particularly, to an actuator which remains in the condition in which it is set when subjected to mechanical shock or vibration.

Shock and vibration resistant electrical switches are known, for example, as disclosed in U.S. Pat. No. 4,423,296. As disclosed therein, a switch has both contacts rotatably secured and balanced so that the axis of rotation passes through the mass center of gravity of each of the contacts. As a result, moments about the axis of rotation for each contact induced by mechanical shock loads are equal and, therefore, balanced.

It is desirable to provide an actuator for such a switch which is also shock and vibration resistant so that the switch can be remotely operated. Further, the present inventor recognizes that such a shock and vibration resistant electrical switch may serve as a circuit breaker with a shock and vibration resistant magnetically operated actuator.

A shock and vibration resistant magnetically operated actuator according to the present invention comprises a pair of magnetically responsive elements secured to each other in fixed spaced relation for rotation about an axis passing through the combined mass center of gravity of the elements. The elements are angularly spaced relative to each other about the axis. A pair of coil means are fixed in angular spaced relation about the axis. Each coil means corresponds to and is adjacent to a different element for creating a magnetic field adjacent thereto in response to an applied current. Each coil means is spaced from its corresponding element so that it is always magnetically coupled to that element when energized. The angular spacing of the coil means is different than the angular spacing of the elements to each other so that one coil means and its element are magnetically aligned and the other coil means and its element are magnetically misaligned. The misalignment is such that when the misaligned coil means is energized, its element, in response to that coil mean's field, tends to rotate into alignment with that coil means and the other element tends to rotate into misalignment with its coil means. Circuit means selectively applying a magnetic field inducing current to the coil means one at a time.

Figure 1:
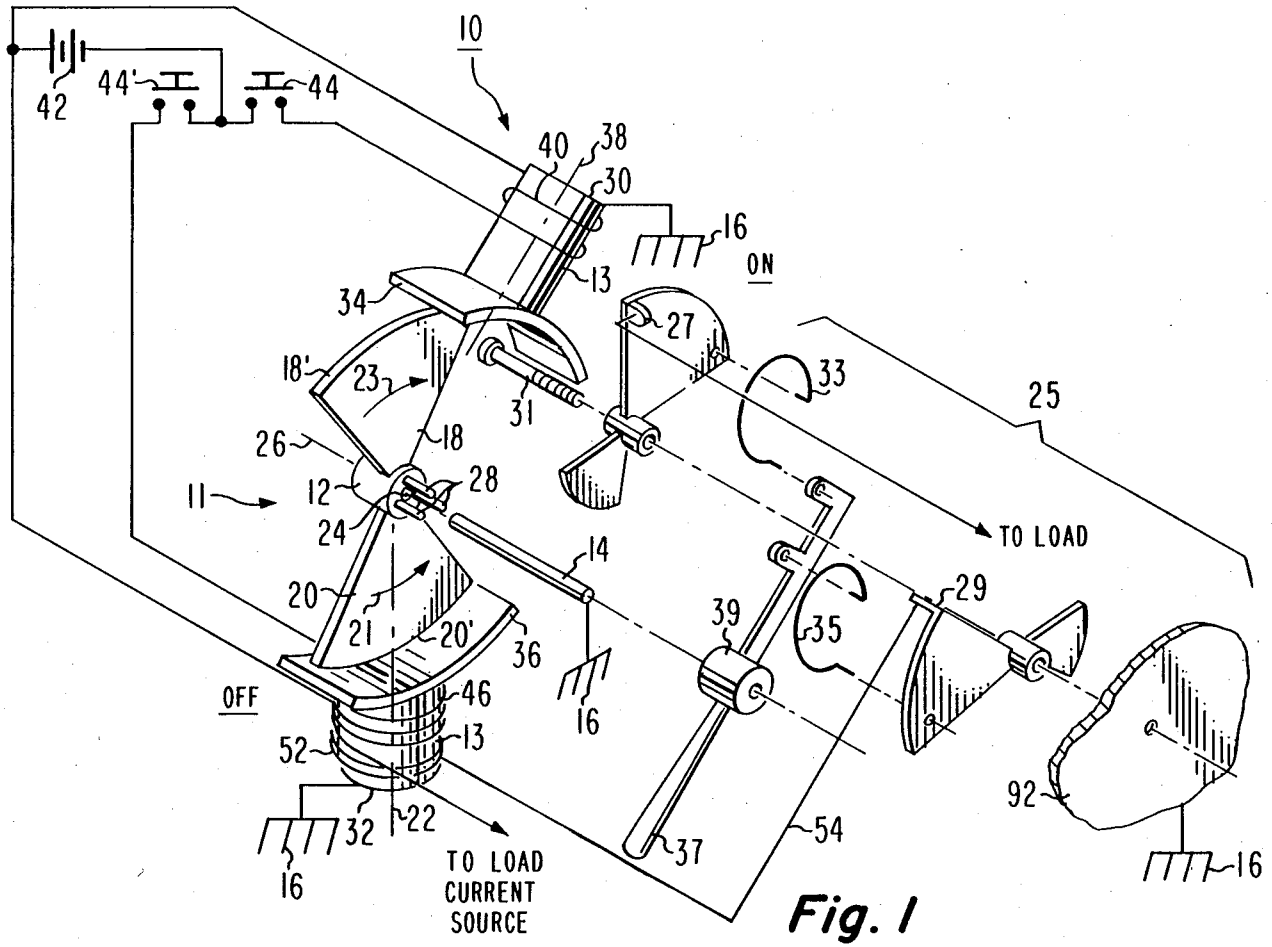
FIG. 1 is an isometric view of a magnetically operated actuator according to one embodiment of the present invention and the coupling of that actuator to a shock and vibration resistant switch in exploded form.

In FIG. 1, magnetically operated actuator 10 comprises a rotor 11 and a stator 13. The rotor 11 comprises a bearing 12 and two outwardly radially extending magnetic material vanes 18 and 20 which may be made, for example, of soft iron. Bearing 12 has a journal 24. A trio of coupling pins 28 project axially parallel and symmetrical to axis 26 from bearing 12 for connecting rotor 11 to a driven mechanism such as a switch 25. Vanes 18 and 20 have respective circular outer edges 18′ and 20′. Vanes 18 and 20 are identical and their combined mass center with bearing 12 lies on the axis 26. Vanes 18 and 20 are symmetrical relative to a radial line 22 passing through and normal to axis 26 and their combined mass center of gravity. Journal 24 rotatably receives shaft 14 secured to a fixed support represented by symbols 16.

Because the mass center of gravity of the rotor 11 lies on axis 26, the sum of the moments about axis 26 produced by acceleration induced forces by rotor 11 are equal and 180° apart. Any shock transmitted to the rotor 11 results in uniform forces being created by the rotor along the length of the rotor, for example, normal to line 22. The sum of the moments produced by the rotor created forces about axis 26 thus are equal and opposite and no motion of the rotor 11 about axis 26 takes place in response to such forces. Therefore, under shock and vibration condition, rotor 11 remains stationary and is not displaced.

Stator 13 comprises a first pole piece 30 secured to a fixed support, symbol 16, and a second like pole piece 32, also secured to a fixed support. Secured to pole pieces 30 and 32 are respective like arcuate pole shoes 34 and 36. Pole pieces 30 and 32 and shoes 34 and 36 may be made of the same magnetic material, for example, soft iron. Magnetic flux in the pole pieces 30 and 32 flows with low flux resistance to the respective connected shoes. Shoe 34 is a circular segment which is closely spaced to circular edge 18′ of vane 18 and shoe 36 is a similar circular segment closely spaced from the circular edge 20′ of vane 20. The spacing of the shoes to the corresponding vanes is sufficiently close to provide good magnetic coupling of flux from the shoes to the vanes.

Pole piece 30 and its shoe 34 are aligned on radial line 38 and pole piece 32 and its shoe 36 are radially aligned on line 22. Maximum flux is emanated from shoes 34 and 36 along respective lines 38 and 22. Lines 22 and 38 intersect preferably at an angle of about 45° in one implementation. Shoe 34 is thus magnetically misaligned relative to edge 18′ of its corresponding vane 18 when the shoe 36 is magnetically aligned with the edge 20′ of its corresponding vane 20. In the converse, when vane 18 is magnetically aligned with pole piece 30 and shoe 34 on line 38, pole piece 32 and its shoe 36 are magnetically misaligned relative to vane 20 by that 45° angle. The edges 18′ and 20′ of the vanes and the shoes have the same arcuate length. That length is sufficiently great such that when a shoe and vane are misaligned as shown by vane 18 and shoe 34, there is overlap of a sufficient portion thereof to provide good magnetic coupling therebetween when flux is present at the corresponding shoe.

Field inducing coil 40 is wound about pole piece 30 and coupled to a power source, battery 42, via momentary normally open pushbutton switch 44. A second winding 46 identical to winding 40 is wound about pole piece 32 and coupled to battery 42 via momentary normally open pushbutton switch 44′. A third coil 52 is wound about pole piece 32 and is coupled to a circuit to be protected (not shown) for receiving a load current from that circuit. Coil 52 is coupled in series with that circuit and a current source (not shown) via contacts 27 and 29 of shock and vibration resistant switch 25. Contact 29 is coupled to one lead of coil 52 by conductor 54. Contact 27 is coupled to the load which is powered by the current source. The other lead of coil 52 is also coupled to the current source.

Switch 25 is described more fully in U.S. Pat. No. 4,423,296 which is incorporated by reference herein.

Switch 25 comprises two like contacts 27 and 29 secured for rotation about a non-conductive shaft 31 which in turn is secured to support 92. A pair of U-shaped springs 33 and 35 couple each of the respective contacts 27 and 29 to non-conductive arm 37. Arm 37 rotates about axis 26 and shaft 14 in directions 21 and 23. Rotation of arm 37 in one of directions 21 and 23 places the contacts 27 and 29 in the open or closed switch state, as more fully described in the aforementioned patent. Load current from a circuit under protection (not shown) is applied through contacts 27 and 29, when closed, to coil 52.

Rotation of arm 37 in direction 23 closes the contacts 27 and 29 coupling the load current to coil 52. Rotation of the arm 37 in the opposite angular direction 21 opens the contacts removing the load current from coil 52 and from the circuit to which that load current is supplied. Coupling pins 28 of rotor 11 are coupled to arm 37 bearing 39 for rotatably driving arm 37 in a selected one of directions 21 and 23. Therefore, rotation of rotor 11 in direction 21 removes current from coil 52 and rotation in direction 23 applies current to coil 52. The switch 25 is shock and vibration resistant and has two stable states. It is a snap-action device which holds the open and closed states without further application of force to arm 37 after the switch is placed in a given state.

In operation of the actuator of FIG. 1, the illustrated state of switch 25 and actuator 10 is off. That is, no current is flowing in coils 40, 46, or 52. Only one of coils 40 and 46 is energized at a time in accordance with the momentary closing of one of switches 44 and 44'. To close switch 25, a current is applied to coil 40 by momentary closing switch 44. The current in coil 40 causes its pole piece 30 and its magnetically coupled shoe 34 to produce a magnetic field whose flux is coupled to the then misaligned magnetic vane 18. Because vane 18 is misaligned relative to the pole piece 30 and shoe 34 the magnetic flux thereof concentrated at line 38 pulls and rotates the vane 18 in direction 23 until vane 18 edge 18' is aligned with shoe 34 in which alignment the magnetic coupling therebetween is greatest. When the field applied by coil 40 is present, there is no field produced by coils 46 and 52 because switches 44' and 25 are open. Vane 20 offers no resistance to the pulling action in direction 23 of the field created by coil 40 on vane 18. This rotation of the rotor 11 in direction 23 misaligns vane 20 relative to shoe 36 similar to the illustrated misalignment of vane 18 and shoe 34.

Rotation of rotor 11 in direction 23 snap closes switch 25 contacts and applies a load current from the circuit to be protected (not shown) to coil 52. The circuit under protection normally applies a current to coil 52 of such a value that the resulting magnetic flux is less in magnitude than the magnetic flux of coil 46. The toggle force of switch 25 is greater than the magnetic pulling force of the flux created by coil 52. The normal flux of coil 52 therefore cannot realign the now misaligned vane 20 and shoe 36 to operate the rotor 11. Thus, rotor 11 and switch 25 remain in position. When it is desired to open the circuit to be protected by opening switch 25, switch 44' is momentarily closed to couple a current to coil 46, creating a momentary magnetic flux at shoe 36. The magnetic flux at shoe 36 is sufficiently greater in magnitude than the holding toggle force of switch 25, and also the flux of coil 52 during normal operation, to rotate rotor 11 in direction 21 to align vane 20 with shoe 36 as shown in FIG. 1. Rotor 11 pins 28 rotate arm 37 of switch 25 in direction 21 which opens the switch 25 contacts 27 and 29 and decouples the load current from coil 52. This is because the displacement of rotor 11 in direction 21 aligns vane 20 with shoe 36 and breaks the circuit between the circuit under protection and coil 52. This action also removes the flux from shoe 36 created by the current to coil 52 after alignment with vane 20 is reached. Rotor 11 easily displaces in directions 21 and 23 in response to the flux produced by coils 40 and 46.

Should a current flow through the circuit under protection beyond a given threshold value, however, then that current flowing through coil 52 produces a magnetic flux in pole piece 32 and shoe 36 that tends to align the normally misaligned vane 20 with shoe 36 in direction 21. The alignment of vane 20 with shoe 36 overrides the toggle force of the switch 25. This action opens switch 25 as discussed above and removes the load current from the circuit to be protected. Thus, the illustrated alignment of shoe 36 with vane 20 on radial line 22 represents the off state of switch 25 and the alignment of vane 18 (line 22) with shoe 34 on line 38 represents the on state of that switch.

In order for the circuit under protection to remain coupled in circuit when the normal current flowing through coil 52 is coupled to the coil by that switch, then it is necessary that the flux produced by coil 52 by the normal current through the circuit under protection produce a force of lower value than the force produced by the toggle snap springs 33 and 35 of switch 25. In this way, the switch overcurrent tripping flux produced by coil 52 must necessarily be greater than the non-tripping flux produced by the normal current flowing in coil 52 which is always present due to current being supplied from the circuit under protection.

In the alternative, a power supply toggle switch (not shown) having two stable states may be used in place of momentary switches 44 and 44' for operating a non-snap type switch in place of switch 25. In this case, such a power supply toggle switch applies a holding current continuously either to coil 40 or to coil 46. The switching states of such a toggle switch automatically decouples current from one of coils 40 and 46, removing the flux therefrom while creating flux at the other coil. The flux in this case produced by coil 40 therefore would be greater than the normal flux produced by coil 52 to operate the load current switch and less than the overcurrent flux produced by coil 52. That overcurrent flux must overcome the lower flux of coil 40. The continuous application of current to coils 40 and 46 serve as holding currents for holding the rotor in place in the absence of a toggle force on the rotor operated load switch.

Because the stator 13 is fixed in place, the only moving element in the system, rotor 11, notwithstanding switch 25, is dynamically balanced and is unresponsive to shock and vibration forces and, therefore, is not tripped by any such shock and vibration forces. Only a positive coupling of flux through the respective pole pieces produced by the corresponding circuits rotates the rotor. In this way, the actuator 10 of FIG. 1 acts as a magnetically operated device, e.g., a circuit breaker, and is responsive solely to magnetically induced forces and not mechanically induced shock forces.

Figures 2, 3:
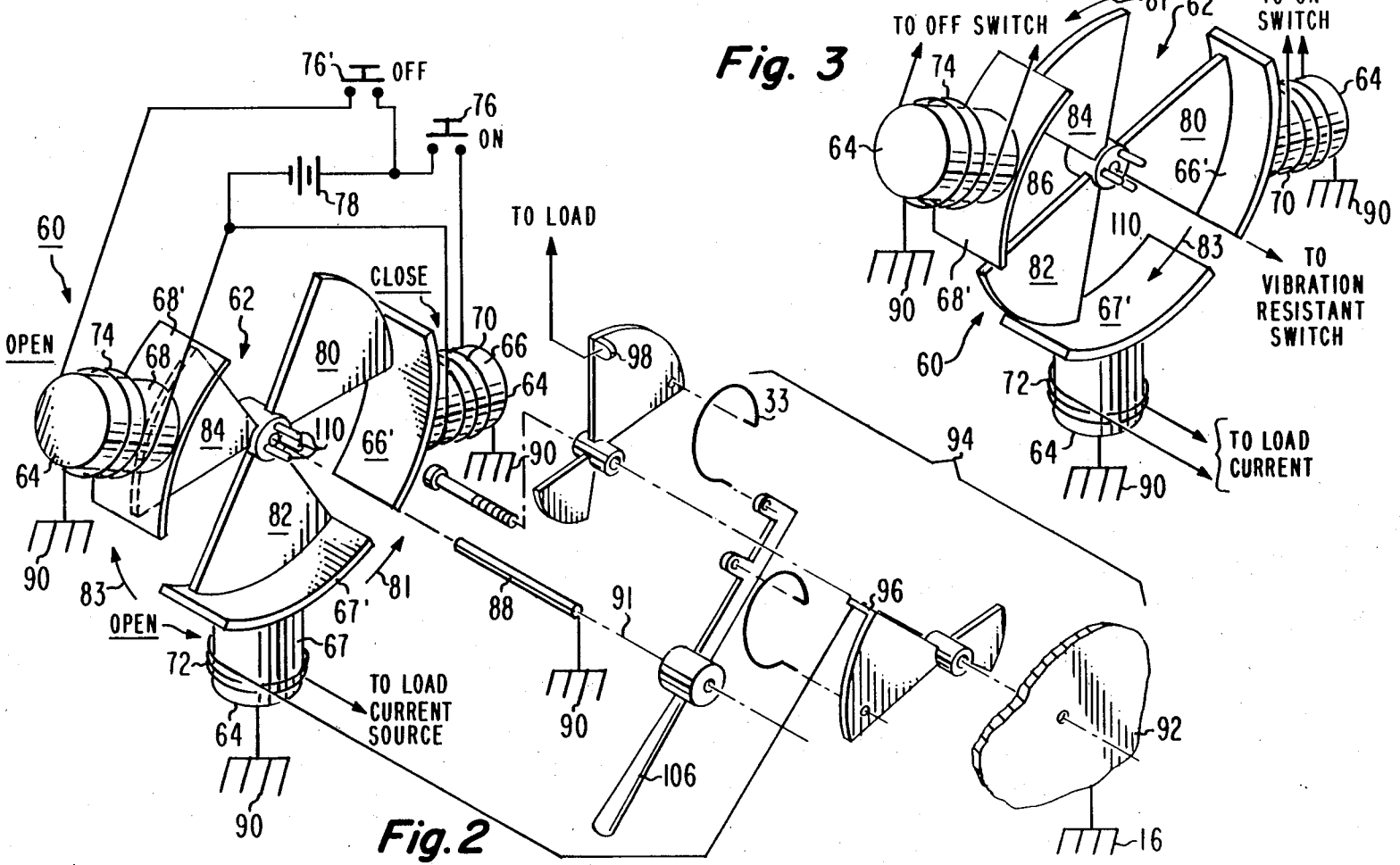
FIG. 2 is an isometric view of a second embodiment of a magnetically operated actuator according to the present invention.
FIG. 3 illustrates the magnetically operated actuator of FIG. 2 in a second different state.

In FIG. 2, actuator 60 comprises a rotor 62 and a stator 64. Stator 64 comprises three pole pieces 66, 67, and 68 which may be of identical construction. Magnetically coupled to each of the pole pieces is a corresponding circular segment shoe 66', 67', and 68'. The shoes and pole pieces are magnetic material. Wound about pole pieces 66, 67, and 68 are respective coils 70, 72, and 74. Coils 70 and 74 are coupled to battery 78 through respective momentary switches 76 and 76'. Only one of coils 70 and 74 is energized by battery 78 at a given instant. Coil 72 is coupled to a load current from a circuit to be protected (not shown).

The rotor 62 comprises three identical magnetic material vanes 80, 82, and 84. Vanes 80, 82, and 84 each have a circular segment outer peripheral edge which is closely spaced from a corresponding respective shoe 66', 67', and 68'. The vanes 80, 82, and 84 extend radially outwardly from bearing 86 which is journaled to a shaft 88. Shaft 88 and stators 64 are secured to a support represented by symbols 90. The mass center of gravity of rotor 60 lies on the axis 92 of rotation of bearing 86 relative to shaft 88.

The vanes 80, 82, and 84 are radially aligned on lines equally spaced about axis 91 passing through the mass center of gravity of the rotor 62. Pole pieces 66, 67, and 68 have a different radial alignment than the vanes 80, 82, and 84. Pole pieces 67 and 68 have the same angular spacing as vanes 80, 82, and 84, for example, 120°. However, pole piece 66 has a different angular spacing from pole piece 67 as compared to its spacing from pole piece 68. For example, the mass centers of vanes 80, 82, and 84 are aligned on radial lines spaced 120° apart. Pole pieces 67 and 68 are spaced on radial lines 120° apart, but pole piece 67 may be spaced from pole piece 66 by an angle of 75°, whereas pole piece 66 may be spaced from pole piece 68 by an angle of 165°. A magnetic field at either of shoes 68' and 67' pull vanes 82 and 84 into magnetic alignment therewith in direction 81 and rotate vane 80 out of alignment with shoe 66' and its pole piece 66. A magnetic field at shoe 66' pulls vane 80 in direction 83 in alignment therewith and vanes 82 and 84 out of alignment with their shoes. When vane 80, shoe 66', and pole piece 66 are radially aligned, then vanes 82 and 84 are respectively misaligned with their corresponding pole pieces and shoes.

Pole piece 66 and its coil 70 represent, when energized and aligned, the closed state of switch 94 which is identical to switch 25 described above. Pole pieces 67 and 68 and their coils, when energized and aligned, represent the open state of switch 94. The FIG. 2 embodiment illustrates a switch 94 open state and FIG. 3 represents the switch 94 closed state.

To close switch 94, switch 76 is momentarily closed to apply a current to coil 70. The magnetic flux of pole piece 66 and its coupled shoe 66' rotates rotor 60 in direction 83, aligning vane 80 with shoe 66'. This misaligns vanes 82 and 84 with their respective shoes 67' and 68'. The switch 94 contacts 96 and 98 close applying a load current from the circuit to be protected to coil 72. The flux induced by coil 72 under normal load current is less in magnitude than the toggle force of switch 94. Therefore, the normal load current applied to coil 72 is insufficient to realign vane 82 with shoe 67'.

In case of overcurrent, however, the load current increases in magnitude above a given threshold and produces a magnetic flux at shoe 67' sufficiently greater than the switch 94 toggle holding force, causing vane 82, FIG. 3, to align with shoe 67'. This alignment misaligns vane 80 with shoe 66' as shown. The alignment of vane 82 with shoe 67', FIG. 3, rotates arm 106 of switch 94, FIG. 2, opening the switch contacts, removing the load current from coil 72 and from the circuit under protection. Thus, when the rotor 62, FIG. 3, is rotated to the off state of FIG. 2, no current is passing through coil 70 and the actuator remains in the off state. To open switch 94, in normal operation, switch 76' is momentarily closed to apply a current to coil 74, FIG. 3. That current produces a flux at shoe 68' greater in magnitude than the flow of the load current coil 72 produced by a normal load current. The flux at shoe 68' rotates rotor 62 in direction 81 aligning vanes 84 and 82 with their respective shoes 68' and 67'.

While a manual switch has been shown to supply power to operate the actuator device, it should be understood that an electronic system can also be the source of a current to operate the actuator and the coupled switch. In the claims, the term "magnetically aligned" refers to the alignment of a magnetic material vane to the line of maximum flux of a given pole piece. While vanes have been illustrated, other shapes and construction can also be used. Also, radial alignment of the vanes and pole pieces is by way of example as other arrangements may also be used. For example, the pole piece may be positioned at a side of the magnetic vane rather than in radial alignment therewith. It is also apparent that the actuator may be used as switch actuator without a circuit breaker feature. In this case the load current coil need not be employed. The number of windings, coil wire size, pole piece sizes and so forth are in accordance with a given implementation. The system disclosed is intended to be representative rather than limiting.

What is claimed is:

1. A shock and vibration resistant magnetically operated actuator comprising:

a pair of nonmagnetized magnetically responsive elements secured to each other in fixed spaced relation for rotation about an axis passing through the combined mass center of gravity of the elements, sid elements being angularly spaced relative to each other about said axis;

a pair of coil means fixed in angular spaced relation about said axis, each coil means corresponding to and adjacent to a different element, each coil means for creating a magnetic field adjacent thereto in response to an applied current, each coil means being spaced from its corresponding element so that it is always magnetically coupled to that element when energized, the angular spacing of the coil means being different than the angular spacing of the elements to each other about said axis so that one coil means and its element are magnetically aligned and the other coil means and its element are magnetically misaligned, the misalignment being such that when the misaligned coil means is energized, its element, in response to that coil means's field, tends to rotate into alignment with that coil means and the other element tneds to rotate into misalignment with its coil means; and circuit means for receiving a magnetic field inducing current and for selectively applying said received current to each said coil means.

2. The actuator of claim 1 further including a third coil means coupled to one of said pair of elements and responsive to an applied current different than currents applied to said pair of coil means.

3. The actuator of claim 1 wherein each said coil means comprises a pole piece and a shoe coupled to the pole piece and made of magnetic material and a coil wound about that pole piece, each shoe adjacent a different element.

4. The actuator of claim 3 further including a third coil wound about one of said pole pieces for receiving a third applied current different than the currents applied to the other coils.

5. The actuator of claim 1 further including a third magnetically responsive element secured to said pair of elements for rotation about said axis such that said axis passes through the combined mass center of gravity of the three elements, said third element being angularly spaced in fixed relation from the pair of elements about said axis; and a third coil means fixed in angularly spaced relation to the pair of coil means about said axis and corresponding to the third element, the third coil means being spaced from its corresponding element to always be magnetically coupled thereto when energized, the magnetic alignment of the third element to its coil means being the same as the alignment of one of the pair of coil means to its element.

6. The actuator of claim 1 further including first switch means having open and closed switch states, each state corresponding to a different element-coil means alignment, said switch means being coupled to and responsive to the rotation of said elements for placing the switch means in one of its states in response to the energization of one misaligned coil means and in the other of its states in response to the energization of a different misaligned coil means.

7. The actuator of claim 6 wherein said circuit means includes second switch means and means for coupling the second switch means to one of the coil means for selectively applying an electrical current through the second switch means to the one coil means to close the first switch means and for selectively applying an electrical current through the second switch means to the other of said coil means to open the first switch means.

8. A shock and vibration resistant magnetically operated actuator comprising:

a plurality of nonmagnetized magnetically responsive elements in a first fixed spaced relation;

means for securing said elements for rotation about an axis passing through their combined mass center of gravity;

first, second, and third magnetic field producing means secured in a second fixed spaced relation, each field producing means being responsive to an applied electric current for creating a magnetic field, each element secured adjacent to and corresponding to a given field producing means and coupled to the magnetic field of that means, when energized, at least one element corresponding to one of said field producing means and being magnetically aligned with the corresponding field producing means in one relative orientation therebetween, the remaining ones of said field producing means and corresponding elements being magnetically misaligned in that orientation, said remaining ones of said field producing means and corresponding elements being magnetically aligned during the magnetic misalignment of said at least one element and the corresponding field producing means in a second orientation therebetween, a magnetic field of a given field producing means tending to rotate its coupled misaligned element into alignment therewith; and means for receiving magnetic field inducing current and for selectively applying the received current to said field producing means.

9. The actuator of claim 8 further including shock and vibration resistant switch means having open and closed switch states, means for coupling the switch means to said elements for switching the switch means state in response to the rotation of said elements, said elements placing the switch means in the open state in response to energization of one of said two field producing means and in response to energization of the other of said two field producing means by an energized amount greater than the energization amount of the other of said two field producing means.

10. In a magnetically operated shock and vibration resistant switch system including a shock and vibration resistant electrical switch having first and second contacts secured for rotation about their respective mass centers of gravity, said contacts having closed and open stable switch states for passing a load current in one of said states, said system including a magnetically operated actuator for selectively placing said switch in said states, said actuator comprising:

a set of radially outwardly extending angularly spaced nonmagnetized elements responsive to a magnetic field coupled thereto secured for rotation about an axis, said axis passing through the mass center of gravity of said elements;

means for coupling said elements to said contacts for operating said contacts according to the angular position of said elements relative to said axis;

a set of magnetic field creating coils secured in fixed spaced relation, each coil adjacent a given element such that its magnetic field, when present, is always coupled to that element, the field of a given coil tending to rotate and radially align the corresponding element thereto, the spacing of said coils being different than the spacing of the elements such that when at least one coil is radially aligned with its element and at least one other coil is radially misaligned with its element; and means for selectively energizing at least one of said misaligned coils to rotate all said elements and switch the state of said contacts.

11. The system of claim 10 wherein a first coil is normally misaligned with its element when the switch is closed and is coupled to receive said load current, a second coil normally aligned with its element in said closed switch state is coupled to receive a first operating current, and a third coil normally misaligned with its element in the closed switch state is coupled to receive a second operating current for opening the switch in response to said second operating current applied thereto, means for selectively applying said first and second operating electric currents to said second and third coils respectively, said first and second operating currents tending to create magnetic fields greater in value than the field normally produced by the first coil when said load current is less than a given value but, less in value than the field produced when the load current exceeds the given value, such normally produced load current field is insufficient to align its element to its coil and said field produced when said load current greater than said threshold value aligns its corresponding element.

12. In combination:

a support;

first and second switch contacts rotatably secured to the support for rotation about an axis, said axis passing through the mass center of gravity of the contacts;

spring means for selectively placing the contacts in stable open and closed switch states;

first, second, and third magnetically responsive nonmagnetized elements rotatably secured to said support for rotation about said axis, said axis passing through the mass center of gravity of said elements, said elements extending radially away from said axis;

first, second, and third magnetic field inducing coils, each coil adjacent a different corresponding element, the spacing of the coils being such that a first of said coils is radially aligned with a corresponding element, the remaining coils being radially misaligned with their corresponding elements in one orientation, the first coil being radially misaligned and the remaining coils being radially aligned in a second orientation, said coils when energized, creating magnetic fields each coupled to its respective element in the one and second orientations, the magnetic fields tending to rotate the misaligned elements into alignment with the respective coils;

means for coupling one of said remaining coils to said switch contacts; and means for coupling coil operating means to the other of said remaining coils and to the first coil for selectively energizing said remaining coil and first coil.

13. A shock and vibration resistant magnetically operated switch comprising:

a shock and vibration resistant switch having open and closed switch states including means for manually placing the switch in at least the closed state;

means for applying a force of a given value to the switch to hold the switch in said closed state;

a nonmagnetized magnetically responsive element secured for rotation about an axis passing through its mass center of gravity, said element including means for coupling it to said switch such that the element has a first angular position when the switch is in the open state and a second angular position when the switch is in the closed state; and coil means fixed aligned in said first angular position about said axis, said coil means corresponding to and adjacent to said element, said coil means for creating a magnetic field adjacent thereto in response to an applied current, said coil means being spaced from said element so that it is always magnetically coupled to that element when energized, the angular spacing of the coil means to the element being such that the coil means and its element are magnetically aligned in said first position and are magnetically misaligned when the element is in said second angular position, the misalignment being such that when the misaligned coil means is energized with a current above a given threshold value, a force is created on the element greater than the given value, the element, in response to that coil mean's field generated force, tends to rotate into alignment with that coil means placing the switch means in the open state.

* * * * *